United States Patent [19]

Oetken et al.

[11] 4,415,833

[45] Nov. 15, 1983

[54] TUNGSTEN HALOGEN LAMP WITH COILED GETTER

[75] Inventors: James E. Oetken, Winchester; Jeffrey P. Buschmann, Lexington, both of Ky.

[73] Assignee: GTE Products Corporation, Stamford, Conn.

[21] Appl. No.: 306,793

[22] Filed: Sep. 29, 1981

[51] Int. Cl.[3] ..... H01K 1/54

[52] U.S. Cl. ..... 313/559; 313/579

[58] Field of Search ..... 313/174, 222, 178, 179

[56] References Cited

U.S. PATENT DOCUMENTS

| | | | |
|---|---|---|---|
| 2,668,253 | 2/1954 | Taylor | 313/174 |
| 2,939,986 | 6/1960 | Langer et al. | 313/174 |
| 3,346,761 | 10/1967 | Ackerman . | |
| 3,453,476 | 7/1969 | English . | |
| 3,465,193 | 9/1969 | Beuvens et al. | 313/178 |
| 3,466,489 | 9/1969 | Audesse et al. | 313/222 |
| 3,762,995 | 10/1973 | Gulbransen et al. | 313/174 |
| 3,821,585 | 6/1974 | Jansson et al. | 313/178 |
| 3,829,729 | 8/1974 | Westlund, Jr. et al. | 313/174 |
| 3,829,731 | 8/1974 | T'Jampens et al. | 313/174 |
| 3,849,687 | 11/1974 | Huston et al. | 313/179 |
| 3,891,885 | 6/1975 | Wurster | 313/178 |
| 4,096,405 | 6/1978 | Goto | 313/174 |
| 4,174,488 | 11/1979 | Weterings . | |

*Primary Examiner*—Alfred E. Smith
*Assistant Examiner*—Carolyn E. Fields
*Attorney, Agent, or Firm*—Lawrence R. Fraley

[57] ABSTRACT

A single-ended tungsten halogen lamp having a tubular hardglass evenelope containing an inert gas and a halogen, preferably bromine. An improved halogen regenerative cycle in this type of lamp is achieved by minimizing the bromine and impurity attack on the tungsten filament, thus increasing lamp life over a wider application temperature range, through the use of a tantalum or zirconium getter which is in the form of a coil. This coil is particularly useful in small volume lamps, and in a preferred embodiment, is attached to the filament mounting structure (bridge) on the side thereof opposite the main filament body.

8 Claims, 4 Drawing Figures

TUNGSTEN HALOGEN LAMP WITH COILED GETTER

DESCRIPTION

1. Technical Field

The present invention relates in general to incandescent lamps of the tungsten halogen type and more particularly to an improvement in the gettering of such lamps.

2. Background

In a tungsten halogen lamp, tungsten particles evaporate from the hot filament and are carried by convection currents to the relatively cool envelope wall. When the temperature of the lamp envelope is sufficiently high, such as on the order of 250° C. or greater, a tungsten halide is formed in the vicinity of the envelope or bulb wall. This tungsten halide does not adhere to the wall but is borne by convection currents back to the filament. The high temperatures at the filament (which may exceed 2500° C.) reduce the tungsten halide into tungsten which redeposits on the filament, and a free halide (such as bromine) in vapor form is formed which recirculates to continue the regenerative cycle. This halogen regenerative cycle is well-known, and the principles have been applied to commercially sold lamps. See, for example, U.S. Pat. Nos. 3,829,729 and 3,849,687 which describe tungsten halogen lamps and particularly those employing a tantalum wire getter. Also refer to U.S. Pat. No. 4,096,405 which shows an incandescent lamp employing a getter within the envelope. Other tungsten halogen lamps are shown in U.S. Pat. Nos. 3,346,761, 3,453,476, and 3,821,585.

In the manufacture of these tungsten halogen lamps, the maintenance of a proper regenerative cycle is significant in providing proper lamp life and performance. Presently, the effectiveness of the regenerative cycle is dependent upon precise control of the halogen (bromine) level and the control of detrimental impurities. However, in adapting these lamps for high volume operation, it is a problem to maintain a tight precise control due to, inter alia, the use of high-speed multihead equipment.

DISCLOSURE OF THE INVENTION

Accordingly, it is an object of the present invention to provide an improved tungsten halogen lamp with means for gettering impurities to extend the useful operating life of the lamp.

Another object of the present invention is to provide a tungsten halogen lamp, preferably containing bromine, and which is characterized by increased lamp life in a wider application temperature range, wherein the gettering action desensitizes the operating temperature range, thus increasing the level of allowable impurities and bromine. The lamp maximum seal temperature may be in the range of 260° C. to 370° C.

A further object of the present invention is to provide an improved and reliable getter means for a tungsten halogen lamp and one which is compatible with high speed lamp manufacturing operation.

Still another object of the present invention is to provide a tungsten halogen lamp characterized by an enhanced halogen regenerative cycle, particularly adapted for low wattage, bridge-type, lamps.

Still a further object of the present invention is to provide an incandescent lamp having an increased operating temperature range yet still maintaining a proper halogen regenerative cycle.

A further object of the present invention is to provide a lamp of the aforementioned type which is adapted for high speed lamp manufacturing with minimized lamp failure.

Another object of the present invention is to provide a tungsten halogen lamp incorporating an improved gettering means having such means located opposite the bridge of a bridge-type lamp from the filament to assure enhanced gettering action.

To accomplish the foregoing and other objects of this invention, there is provided in accordance with the present invention a low wattage tungsten halogen incandescent lamp which comprises a hermetically-sealed, light-transmitting envelope, and an inert fill and halogen disposed within the envelope, a coiled tungsten filament supported within the envelope, and means for gettering impurities also disposed within the envelope. An important feature of the present invention is providing means for the gettering in coil form (coiled getter). This provides an increased surface area for getter absorption, which has been found to be particularly desirable in the construction of small volume lamps. Another important feature of the present invention has to do with the proper location of the getter minor coil so as to assure proper gettering action within the lamp envelope. It has been found in particular that improved gettering results when the minor coil is disposed at the bridge means on the side thereof opposite to the main tungsten filament.

BEST MODE FOR CARRYING OUT THE INVENTION

Figure 1:
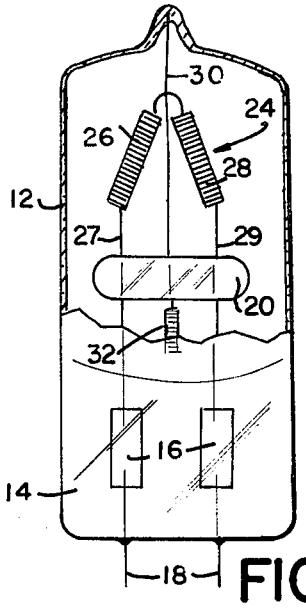
FIG. 1 is a front elevational view partly in section of a tungsten halogen lamp according to a preferred embodiment of the present invention, said lamp employing a CC2V filament.

For a better understanding of the present invention together with other and further objects, advantages, and capabilities thereof, reference is made to the following disclosure and appended claims in connection with the above described drawings.

In the drawings, there are shown four different embodiments of the present invention. Of these embodiments, the preferred ones are those depicted in FIGS. 1 and 3 wherein the getter minor coil is disposed on a side of the mounting bridge opposite the main filament body. The other two embodiments in FIGS. 2 and 4 describe the getter minor coil as being disposed at a top end of the lamp over (and therefor immediately adjacent) the main filament.

Before discussing the details of the improved gettering action of this invention, a discussion follows of the main lamp components. In this regard, like reference characters have been used to identify like parts. Thus, all embodiments comprise a hermetically sealed, light-transmitting envelope 12 of generally tubular (cylindrical) shape and which may have a conventional (press-sealed) base 14. A pair of molybdenum foil seals 16 at the base serve to interconnect the input leads 18 to the filament body. A high melting point material, such as quartz, is typically used for the envelope, although other hardglasses may also be employed. The hermetically sealed envelope is usually filled with an inert gas, such as argon, nitrogen, krypton, or a mixture thereof, and a halogen additive such as iodine or bromine. In accordance with the present invention the lamp envelope is preferably of the bromine fill type. The bromine fill may be provided in the form of a given mixture of hydrogen bromide.

Also common to all four embodiments is a support bridge 20 which also may be constructed for quartz. Any one of a number of different types of filament bodies may be supported from the bridge 20. However, herein are disclosed two basic types of filament bodies to be described hereinafter.

Figure 2:
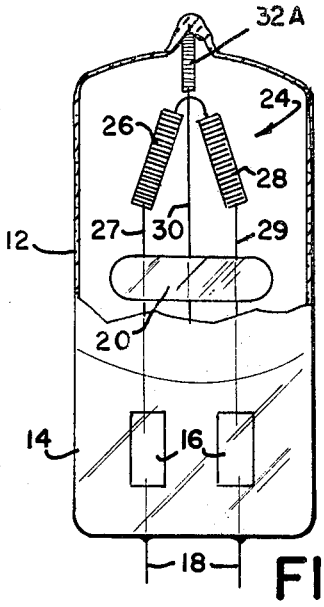
FIG. 2 is a front elevational view partly in section of another embodiment of the invention also having a CC2V filament.

FIGS. 1 and 2 describe a tungsten filament 24 which is of CC2V (coiled coil) filament form including two individual tungsten filament coils 26 and 28. These coils 26 and 28 are secured to respective leads (legs) 27 and 29 to provide upright support for the filament from the bridge 20. Additionally, there is a centrally disposed tungsten support wire 30 which extends longitudinally of the envelope from below the bridge 20 to above the coils 26 and 28.

In the preferred embodiment of FIG. 1, a getter minor coil 32 is secured to a lower end of the tungsten support wire 30. It is noted that the getter coil in the embodiment of FIG. 3, to be discussed hereinafter, is located in a similar position with regard to the bridge 20. It has been found that this particular placement on the bridge 20 on the side opposite to the filament 24 provides an enhancement of the halogen regenerative cycle, thus broadening the lamp application temperature range optimizing lamp life. The gettering principle of the present invention is particularly adapted for use with low wattage long-life lamps such as those rated at 1000–2000 hours. The invention has been applied in the construction of lamps of 100–150 wattage. This coiled getter 32 is preferably constructed of tantalum or zirconium.

The embodiment of FIG. 2, although not providing the optimized operation of the embodiment of FIG. 1, does employ the concept of the present invention of employing a gettering means that is of coil form. This coil form is particularly advantageous when used in small volume lamps. The coil form provides increased surface area for getter absorption. In the embodiment of FIG. 2 the getter coil 32A is secured to the very top end of the tungsten support wire 30 and thus located immediately adjacent filament 24. The coil 32A is disposed above the main filament coils 26 and 28 in the embodiment of FIG. 2 as depicted. The coil 32A may be secured to the wire 30 in any convenient and suitable manner such as welding. The getter coil described herein may be in a simple helix form or can be in other coiled type forms.

Figure 3:
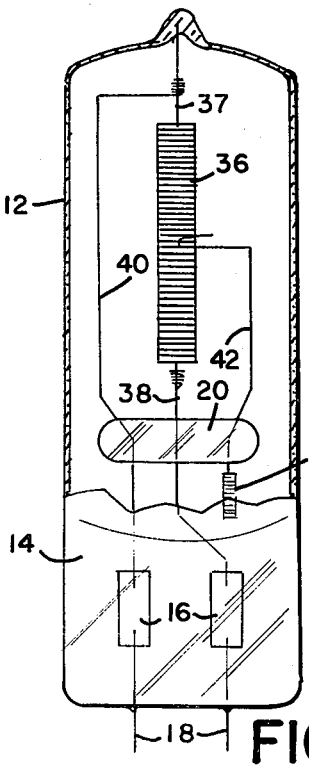
FIG. 3 is a front elevational view partly in section showing still another preferred embodiment of the present invention, said lamp employing a CC8 filament.
Figure 4:
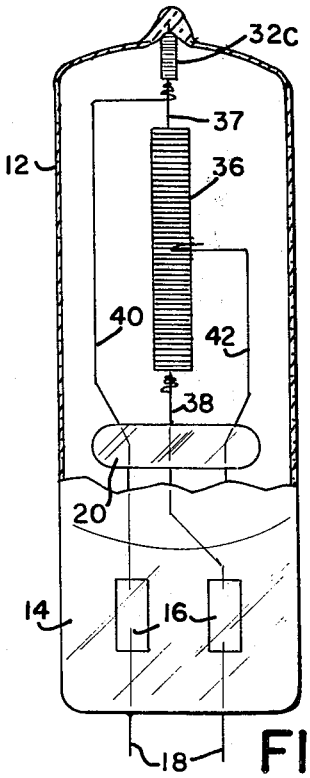
FIG. 4 is a front elevational view partly in section of still a further embodiment of the present invention also employing a CC8 filament.

FIGS. 3 and 4 show another type of lamp employing a different filament structure. The filament described in FIGS. 3 and 4 is a CC8 (coiled-coil) filament comprising a single filament coil 36 secured at each end to leads (legs) 37 and 38 extending, respectively, from the top and bottom of the coil body. There are also provided tungsten support wires 40 and 42. Wire 40 extends from lead 37 to the bridge 20 and wire 42 extends from the coil body 36 to the bridge 20.

In the second embodiment of FIGS. 3 and 4, the preferred version is that found in FIG. 3 which employs a getter minor coil 32B which, like the embodiment of FIG. 1, has the coil disposed below the bridge 20 and is therefor separated from the filament 36 by the bridge. The coil 32B may be secured to the bottom end of the tungsten support wire 42.

In the embodiment of FIG. 4, the getter coil 32C is at the top end of the envelope secured to the top of the lead 37 just above the connecting point of the wire 40 to the lead 37.

The concepts illustrated in FIGS. 1–4 are preferably applied to a bromine type, tungsten halogen lamp of the low wattage variety such as in the 100–150 watt range. The intent is to increase the lamp life over a wider application temperature range. The lamp seal temperature is adapted to be in the range from 260° to 370° C. The gettering action of the tantalum or zirconium coil is adapted to desensitize the operating temperature range and thus increase the permissible amount of impurities and bromine. The getter has an affinity for oxygen, nitrogen, hydrogen and halogen.

The increase in lamp life by employing the principles of the present invention has been quite substantial. With a 100 watt, 120 volt lamp with a seal temperature on the order of 320° C., the average life has increased by a factor of 3.3 in comparison to prior structures. In prior applications with a seal temperature on the order of 320° C. to 370° C. the average life was 310 hours. However, by employing the principles of the present invention, the average life for a lamp having a like seal temperature increased to about 1012 hours.

The coil getter described herein substantially diminishes the halogen attack on the filament and also substantially diminishes the adverse effect of other substances and impurities as they affect the halogen regenerative cycle. Typically, in prior lamps, the lamp coil at 250 hours of use, without the minor coil getter, showed substantial corrosion and dendritic growth of the top support and coil and coil legs, causing early lamp failure. However, at the same 250 hour time period with the lamp employing the minor coil getter of this invention, there was substantially no corrosion or dendritic growth of the support and coil, or coil legs.

The necessary minimum temperature for getter reaction of tantalum is about 350° C., while that of zirconium is about 200° C.

Having described a limited number of embodiments of the present invention, it should now be apparent to those skilled in the art that numerous other embodiments are contemplated as falling within the scope of this invention. For example, in the preferred embodiment, one means has been shown for securing the getter minor coil to the bridge. In other embodiments, other forms of support can be used, all of which preferably support the getter coil on a side of the bridge opposite to that of the main filament.

What is claimed is:

1. In a low wattage tungsten halogen lamp including a hermetically-sealed, light-transmitting envelope, an inert fill and halogen disposed within said envelope, an insulative support bridge located within said envelope, a coiled tungsten filament located within said envelope and supported from said insulative support bridge, a filament support wire secured to and extending from said insulative support bridge for supporting said tungsten filament, and means for gettering impurities within said envelope, the improvement wherein said filament support wire includes an end portion extending from said insulative support bridge on a side opposite said coiled tungsten filament and said means for gettering said impurities within said envelope is in coil form to provide increased surface area for getter absorption, said coil getter secured to said end portion of said filament support wire such that said insulative support bridge is positioned between said coil getter and said tungsten filament.

2. The improvement according to claim 1 wherein the material of said coil getter is selected from the group consisting of tantalum and zirconium.

3. The improvement according to claim 1 wherein said coiled tungsten filament is of a single coil body.

4. The improvement according to claim 1 wherein said coiled tungsten filament is of a double coil body.

5. The improvement according to claim 1 wherein said insulative support bridge is comprised of quartz.

6. The improvement according to claim 1 wherein said light-transmitting envelope includes a single press-sealed end portion.

7. The improvement according to claim 1 wherein said halogen is selected from the group consisting of iodine and bromine and said inert fill is selected from the group consisting of argon, nitrogen, and krypton.

8. The improvement according to claim 1 wherein said coil getter is of simple helix form.

* * * * *